US006123273A

United States Patent [19]

Loprinzo et al.

[11] Patent Number: 6,123,273

[45] Date of Patent: Sep. 26, 2000

[54] DUAL-FUEL NOZZLE FOR INHIBITING CARBON DEPOSITION ONTO COMBUSTOR SURFACES IN A GAS TURBINE

[75] Inventors: Anthony J. Loprinzo, Greenville, S.C.; James R. Maughan, Scotia, N.Y.; H. Lindsay Morton, Simpsonville, S.C.; Stephen Hugh Black, Duanesburg, N.Y.; Anthony John Dean; William Theodore Bechtel, II, both of Scotia, N.Y.; Andrew Luts, Escondido, Calif.

[73] Assignee: General Electric Co., Schenectady, N.Y.

[21] Appl. No.: 08/941,240

[22] Filed: Sep. 30, 1997

[51] Int. Cl.[7] ..... B05B 7/10

[52] U.S. Cl. ..... 239/405; 239/400

[58] Field of Search ..... 239/399, 400, 239/403, 404, 405, 406

[56] References Cited

U.S. PATENT DOCUMENTS

| | | | |
|---|---|---|---|
| 1,641,581 | 9/1927 | Egan | 239/400 X |
| 3,254,846 | 6/1966 | Schreter et al. | 239/400 |
| 3,853,273 | 12/1974 | Bahr et al. . | |
| 4,198,815 | 4/1980 | Bobo et al. . | |
| 4,327,547 | 5/1982 | Hughes et al. | 60/39.46 P |
| 4,407,128 | 10/1983 | Kwan . | |
| 4,609,150 | 9/1986 | Pane, Jr. et al. . | |
| 4,693,074 | 9/1987 | Pidcock et al. . | |
| 4,946,105 | 8/1990 | Pane, Jr. et al. | 239/403 X |
| 5,288,021 | 2/1994 | Sood et al. . | |
| 5,404,711 | 4/1995 | Raiput | 239/400 X |
| 5,615,555 | 4/1997 | Mina . | |
| 5,761,907 | 6/1998 | Pelletier et al. | 239/406 X |
| 5,833,141 | 11/1998 | Bechtel, II et al. | 239/422 X |

FOREIGN PATENT DOCUMENTS 0 455 459 A2 11/1991 European Pat. Off. .

*Primary Examiner*—Andres Kashnikow
*Assistant Examiner*—Sean P. O'Hanlon
*Attorney, Agent, or Firm*—Nixon & Vanderhye

[57] ABSTRACT

The dual-fuel nozzle for a gas turbine and combustor includes a liquid fuel nozzle surrounded by a gas fuel nozzle. A converging sleeve surrounds the converging outer wall of the combined liquid fuel and gaseous nozzle to form a duct of decreasing cross-sectional area in a downstream direction whereby air flow through the duct accelerates toward the conical droplet spray pattern emerging from the liquid fuel nozzle. An inside swirler is located upstream of the liquid fuel tip to swirl the air flowing through the duct. An outer swirler is provided about the downstream end of the sleeve, likewise to swirl air. The accelerated swirling air flow through the duct and outer swirling air flow preclude impingement of oil spray droplets onto metal surfaces of the nozzle and hence prevent carbon deposition thereon which would otherwise be deleterious to the liquid fuel and gaseous nozzles.

11 Claims, 3 Drawing Sheets

DUAL-FUEL NOZZLE FOR INHIBITING CARBON DEPOSITION ONTO COMBUSTOR SURFACES IN A GAS TURBINE

TECHNICAL FIELD

The present invention relates to dual-fuel nozzles for gas turbine combustors that burn liquid fuel at temperatures and pressures conducive to fuel cracking and subsequent solid carbon resin formation on combustor fuel injection hardware that is exposed to liquid fuel prior to evaporation and combustion and particularly relates to a dual-fuel nozzle which inhibits the deposition of carbon on gas fuel-air supply surfaces when operating in a liquid fuel combustion mode.

BACKGROUND

In dual-fuel combustion systems for gas turbines, gaseous and liquid fuel are used separately to fire the gas turbine. For a number of reasons, including the goal of dry low $No_x$ operations, developmental emphasis has been on the efficient use of gas fuel nozzles and the liquid fuel nozzle is typically used only as a backup and only sporadically. However, it has been demonstrated recently that the use of liquid fuel in the gas turbine combustor in lieu of gaseous fuel has a tendency to deposit carbon residue on various passages of the gas/air fuel nozzle which may inhibit return to gas fuel turbine operation.

More particularly, catastrophic combustor failure has resulted from the rapid build-up of carbon deposits in the vicinity of the liquid fuel injection. Carbon deposits developed during liquid fuel operation tend to block off the intended gas or liquid fuel inlet to the combustor liner, causing a backflow of fuel. This results in ignition and flame holding external to the combustor liner, which in turn results in thermal failure. Because the failure does not result in loss of flame and may not result in significant exhaust temperature changes prior to breaching the combustion pressure vessel, these failures can become non-contained prior to control system detection. Serious safety concerns have thus been generated and load restrictions have been required to limit operation of the turbine and hence combustors in load ranges where deposition rates are known to be significant. For example, some failures have been reported following less than 12 hours of operation at adverse high carbon formation rate conditions.

Various efforts to eliminate or accommodate the carbon deposition problem have been proposed. For example, aerodynamic sweeping of surfaces anticipated to experience liquid fuel impingement has been demonstrated to be effective where there is sufficient combustor line pressure drop to create enough air sweep velocity to inhibit deposition. Combustor surface metal temperatures in excess, for example, of 800° F., may also prevent carbon formation. Both of these systems, however, have their respective drawbacks, including substantial usage of inlet air which could be more advantageously used elsewhere, as well as metal cooling problems. Consequently, there has been a demonstrated need to provide a dual-fuel nozzle system of fuel spray distribution and combustor aerodynamic characteristics that minimize or prevent initiation of carbon deposition on air, liquid fuel and gaseous fuel nozzle surfaces. One such dual-fuel nozzle system is disclosed in U.S. Pat. No. 5,833,141, of common assignee herewith. The present disclosure constitutes an improvement upon and a variation of the system disclosed in that prior application.

DISCLOSURE OF THE INVENTION

In accordance with the present invention, a dual-fuel nozzle is provided having a gaseous/liquid fuel nozzle comprising a gaseous nozzle surrounding a central axially disposed liquid fuel nozzle terminating in a tip. In a liquid fuel operating mode, atomizing air and liquid fuel are combined and injected in a generally conical liquid fuel droplet spray pattern downstream of the liquid fuel nozzle tip toward the flame stabilization zone. A convergent sleeve of the dual-fuel nozzle surrounds at least a downstream portion of the gaseous/liquid fuel nozzle. Inlet air, for example, from the compressor, flows through an upstream portion of the converging flow passage or duct defined by the sleeve about the gaseous/liquid nozzle for flow downstream past a throat area of the sleeve and about the emerging liquid fuel spray cone during liquid fuel combustor operation. Gaseous fuel is supplied through a series of circumferentially spaced apertures into the converging air flow passage or duct.

A first, or inside swirler is located in the upstream portion of the air flow passage or duct for swirling air flowing through the duct and providing a swirling air pattern at the downstream throat of the sleeve. Additionally, outside of the downstream portion of the sleeve is an outside or second swirler for swirling inlet air from the compressor and providing swirling air downstream of the liquid nozzle tip and about the swirling air exiting the throat of the sleeve. Thus, the sleeve forms a boundary between the air flows, i.e., a convergent air flow through the inner swirler and duct bounded by the central gaseous and liquid fuel nozzles and an air flow outside the sleeve and passing through the outer swirler. The duct thus separates and conditions the air flow between the swirlers. The exit plane of the inner swirler is located preferably axially forwardly, i.e., upstream of the liquid fuel injection plane and discharges into the converging annulus defined by the gaseous/liquid fuel nozzle and the convergent sleeve. Thus, air flows through the duct and is continuously accelerated in the duct to the duct exit, i.e., the downstream end of the sleeve. This prevents recirculation zones that could entrain liquid fuel in the duct and form carbon deposits. A convergence ratio of at least 5% is provided the duct, i.e., the downstream area adjacent the duct exit should be greater than 5% less the upstream area. The aerodynamic throat exit at the end of the sleeve also provides a strong barrier to flashback into the sleeve during gas fuel operations.

The second or outer swirler forms another aerodynamic barrier to liquid fuel droplets being deposited on metal surfaces of the dual-fuel nozzle as the liquid fuel evaporates in the exit swirl. The pressure drop through the second swirler also prevents the liquid fuel from contacting the surfaces of the sleeve. Further the aerodynamics of the swirlers create a recirculation along the centerline of the liquid fuel passage for effective ignition and flame stability downstream of the nozzles.

In a preferred embodiment according to the present invention, there is provided a dual-fuel nozzle for a gas turbine combustor, comprising a gaseous/liquid fuel nozzle defining an axis and including a liquid fuel nozzle and terminating in a liquid fuel tip for injecting liquid fuel in a spray pattern toward a flame zone downstream of the nozzle, a sleeve surrounding at least a portion of the liquid fuel nozzle and in part defining a generally axially extending air flow passage convergent in a downstream direction toward the axis, the sleeve terminating in an axial plane no further upstream than the liquid fuel tip, the axial flow passage decreasing in cross-sectional area in a downstream direction to accelerate air flow through the passage, a first air swirler upstream of the fuel tip for swirling air introduced into the air flow passage and delivering the swirling air about the liquid fuel spray pattern, and a second air swirler about the sleeve and disposed axially downstream of the first air swirler for swirling air received about the sleeve and flowing swirled air about the liquid fuel spray pattern, whereby impingement of liquid fuel onto the gaseous/liquid fuel nozzle is substantially avoided.

In a further preferred embodiment according to the present invention, there is provided a dual-fuel nozzle for a gas turbine combustor, comprising a gaseous/liquid fuel nozzle defining an axis and including a liquid fuel nozzle terminating in a liquid fuel tip for injecting liquid fuel in a spray pattern toward a flame zone downstream of the nozzle, means surrounding at least a portion of the gaseous/liquid fuel nozzle and in part defining a generally axially extending air flow passage convergent in a downstream direction toward the axis, the sleeve terminating in an axial plane no further upstream than the liquid fuel tip, a first air swirler upstream of the fuel tip for swirling air introduced into the air flow passage and delivering the swirling air about the liquid fuel spray pattern and a second air swirler about the flow passage defining means and disposed axially downstream of the first air swirler for swirling air received externally about the flow passage defining means and flowing swirled air about the liquid fuel spray pattern, whereby impingement of liquid fuel onto the gaseous/liquid fuel nozzle is substantially avoided.

Accordingly, it is a primary object of the present invention to provide a dual-fuel nozzle for a gas turbine combustor which prevents initiation of carbon deposition on the air, gaseous fuel and liquid fuel nozzle surfaces by eliminating impingement of liquid fuel on the combustor metal surfaces over the entire gas turbine operating range.

BEST MODE FOR CARRYING OUT THE INVENTION

Figure 1:
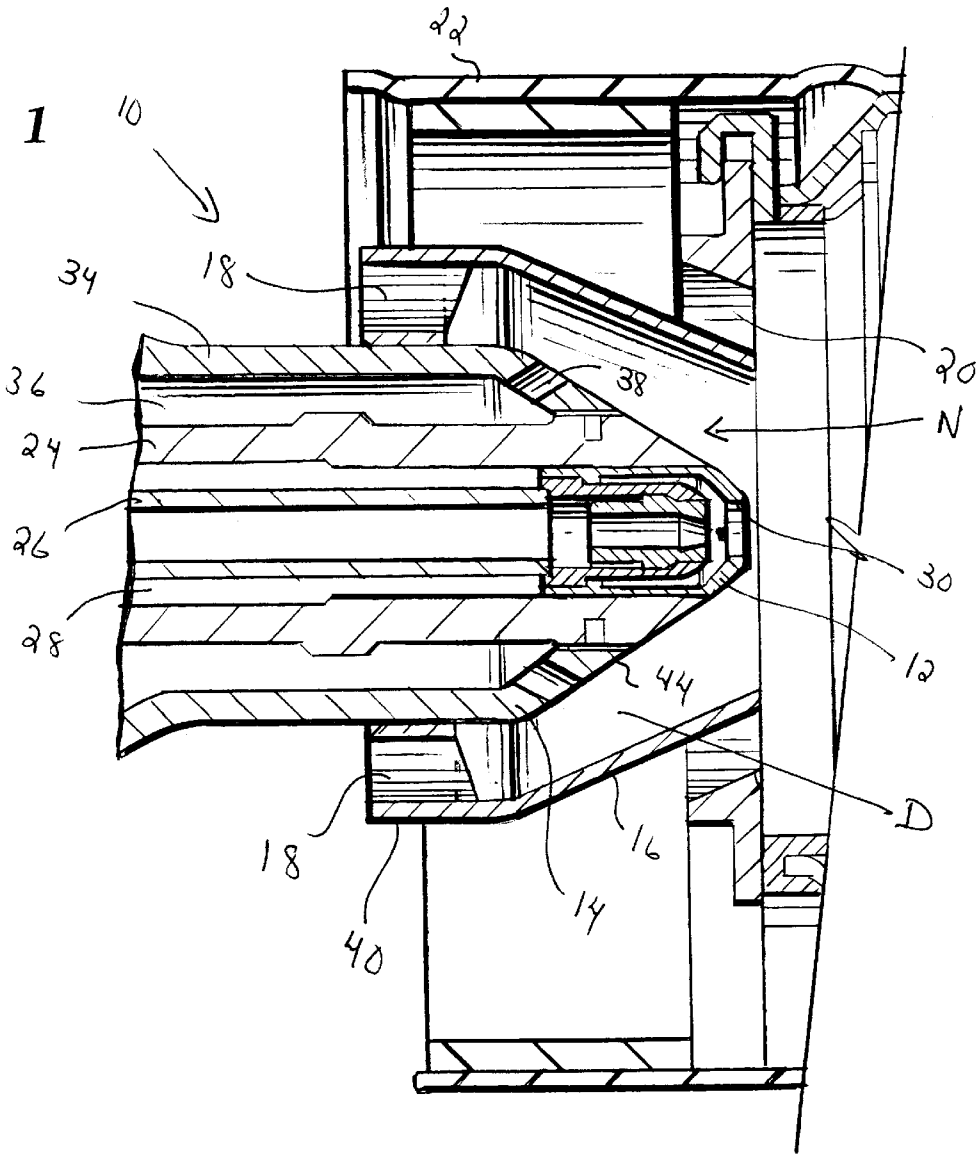
FIG. 1 is a fragmentary cross-sectional view of a dual-fuel nozzle constructed in accordance with the present invention.
Figure 2:
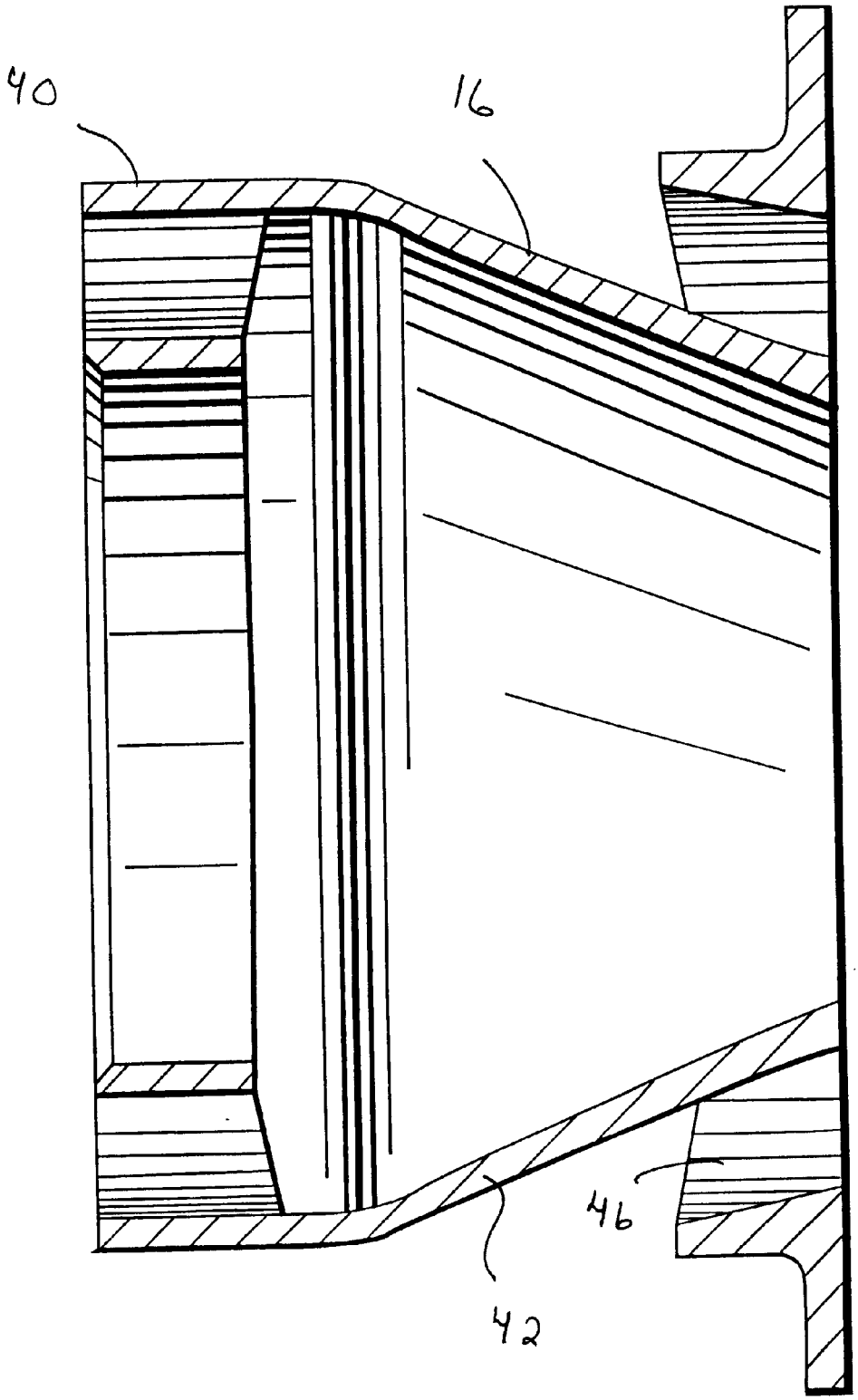
FIG. 2 is an enlarged cross-sectional view of a sleeve and a pair of swirlers forming part of the dual-fuel nozzle of FIG. 1.
Figure 3:
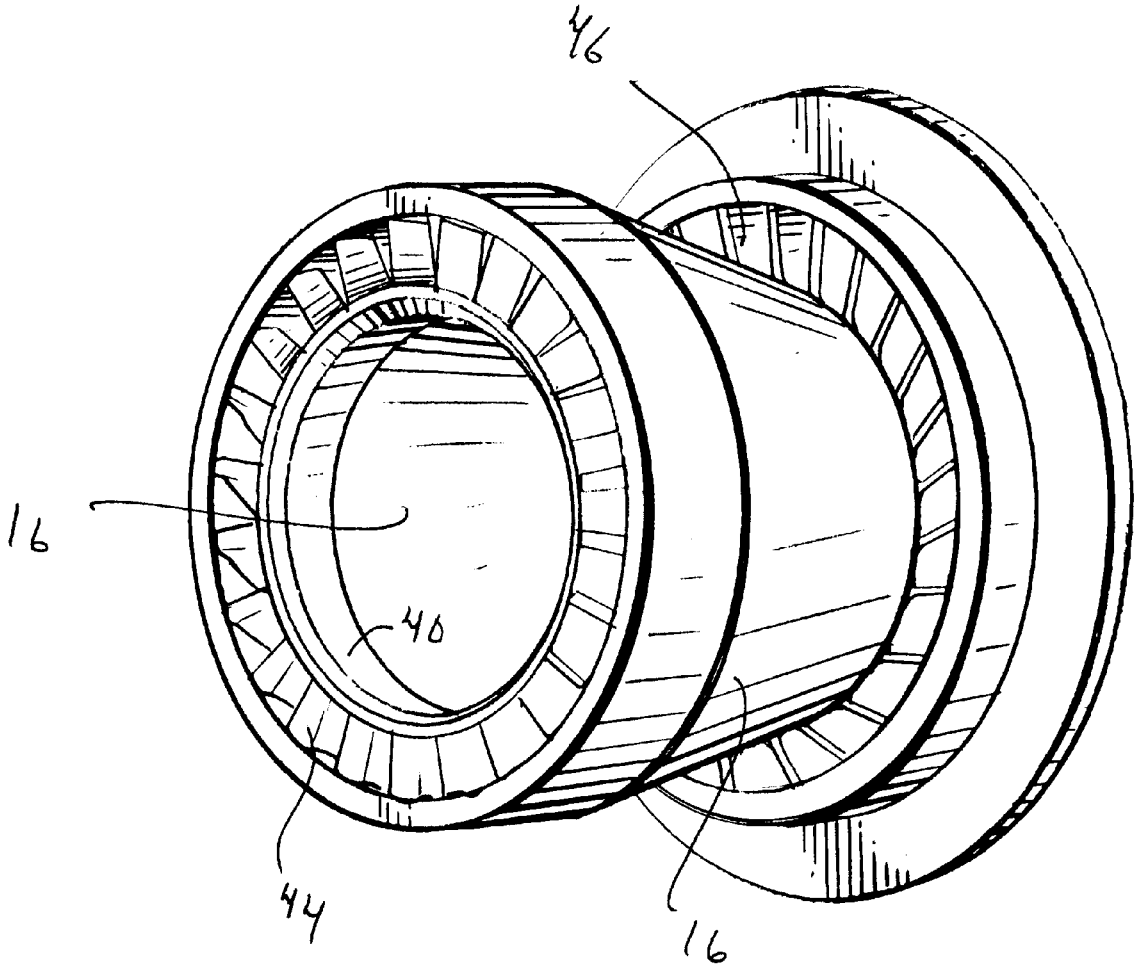
FIG. 3 is a perspective view of the sleeve and nozzles illustrated in FIG. 2.

Referring to FIG. 1, a dual-fuel nozzle according to the present invention and generally designated 10, includes a gaseous/liquid fuel nozzle, generally designated N, comprising a liquid fuel nozzle 12 and a gas fuel nozzle 14 forming part of an integrated structure within a flow passage defining means, such as sleeve 16. Sleeve 16 carries first or inner swirlers 18 and second or outer swirlers 20 within a combustor housing 22. The liquid fuel nozzle 12 and gaseous fuel nozzle 14 are per se conventional. The liquid, e.g., oil, fuel nozzle includes intermediate and inner concentric tubes 24 and 26, respectively, defining an annular passage 28 therebetween for flowing atomizing air through apertures in the tip 30 of the liquid fuel nozzle 12. The inner tube 26 defines a central axial passageway for delivering liquid fuel to the liquid fuel nozzle tip 30. Surrounding the intermediate tube 24 is an outer tubular member or tube 34 which defines an annular passageway 36 for flowing gas fuel through apertures 38 into a duct or air flow passage D, described below. While the major portion of the operation of the combustor is in a gaseous fuel mode, it has been found that liquid or oil droplets from the conical spray pattern of the liquid or oil emerging from the liquid fuel nozzle tip 30 impinge on various metal surfaces of the fuel nozzle outlets and ancillary structures forming a deleterious carbon deposition capable of blocking off fuel flow, causing a backflow of fuel and consequent potential thermal failure as outlined above. Consequently, there has been a need to eliminate the deposition of carbon on the dual-fuel nozzle to avoid thermal failure and also to ensure that the flame does not stabilize inside any air/gas passageways, to promote further fuel/air mixing and to ensure efficient dependable operation of the dual-fuel nozzle over a long period of time.

To accomplish the foregoing, the present invention provides a sleeve generally coaxial with and hence generally concentric about the gaseous/liquid fuel nozzle N. Particularly, the flow passage defining means, such as sleeve 16, preferably has a first upstream annular section 40 spaced from the outer wall 34 of the nozzle N and a converging section 42, likewise spaced from the converging walls 44 of the nozzle N. As will be appreciated, the sleeve 16 forms an annular air flow passage or duct D between it and the exterior walls of the gas and liquid nozzle for flowing air, for example, from a compressor, not shown, convergent toward the axis of the nozzle N in a downstream direction. More particularly, the sleeve 16 converges about the converging outer walls 44 of the nozzle N to provide a reduced cross-sectional area in a downstream direction. This reduced cross-sectional configuration accelerates the flow of air through the passage. While drawing FIG. 1 illustrates a divergence of the sleeve 16 and the walls 44 of the nozzle N relative to one another in a downstream direction, the net reduction in cross-sectional area in the duct in the downstream direction accelerates the air flow through the duct D. Preferably, the cross-sectional area of the duct has a convergence ratio of at least 5%, i.e., the downstream area should be 5% or more less than the upstream area. It will be appreciated that the duct D may be formed otherwise than as a sleeve, e.g., as an integral part of the combustor housing.

As illustrated in the drawing figures, the upstream end of the sleeve 16, i.e., the annular section 40, carries an inner swirler 18 formed of a plurality of vanes 44 designed to impart rotation to the air flowing through the vanes and through the duct between sleeve 16 and walls 44. Additionally, at the downstream end of sleeve 16, there is provided an outer or second swirler 20, likewise having a plurality of vanes 46 for swirling air flowing externally about sleeve 16 in the downstream direction. The vanes 44 and 46 of the inner and outer swirlers 18 and 20, respectively, may provide rotation of the air in the same direction or in opposite directions.

From a review of FIG. 1, it will be appreciated that the inner swirler 18 is located forwardly, i.e., upstream of the liquid fuel nozzle tip 30 and the gaseous fuel openings 38. The sleeve 16 terminates at its downstream end in a plane preferably downstream of the tip 30 of the liquid fuel nozzle but may terminate in axial coincidence with the liquid fuel nozzle tip 30.

It will be appreciated that the swirlers 18 and 20 create a strong recirculation zone for flame stabilization downstream of the swirlers and downstream of the liquid fuel nozzle tip 30. Sleeve 16 forms a boundary between the swirler flows extending from the shroud of the inner swirler to the hub of the outer swirler. The duct thus formed separates and conditions the flow, i.e., by converging and accelerating the air flow in the downstream direction to prevent separation of air flow from the walls of the duct. Thus, the converging and accelerating air flow through the duct is directed downstream and radially inwardly toward the axis of the conical oil spray distribution pattern emerging from the liquid fuel tip 30 when in a liquid fuel mode of operation. This acceleration and convergence in the duct helps to prevent recirculation zones that could otherwise entrain liquid fuel into the duct and form carbon deposits on the metal surfaces. The aerodynamic throat at the exit of the duct provides a strong barrier to flashback in the duct. That is, the convergence of the sleeve and acceleration of the air flow prevents flame ignition in the converging duct. The flame cannot be held in the duct. Stated differently, flame stabilization is forced to occur downstream of the exit plane of the sleeve 16. It will also be appreciated that the pressure drop across the outer swirler 20 prevents liquid fuel droplet contact with the surfaces of the outer swirler 20. Generally, the air flow caused by the swirlers, whether co-rotating or rotating in opposite directions create a recirculation zone along the axis of the nozzle 12 for excellent ignition and flame stability downstream of the nozzle. Also, absent an outer swirler, the metal in that region otherwise available but for the swirler would necessarily have to be cooled, thus increasing the likelihood of carbon deposition on the metal surfaces surrounding the liquid fuel nozzle.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dual-fuel nozzle for a gas turbine combustor, comprising:

a gaseous/liquid fuel nozzle defining an axis and including a liquid fuel nozzle terminating in a liquid fuel tip for injecting liquid fuel in a spray pattern toward a flame zone downstream of said nozzle when said gaseous/liquid fuel nozzle is operated in a liquid fuel mode;

a sleeve surrounding at least a portion of said gaseous/liquid fuel nozzle and in part defining a generally axially extending air flow passage convergent in a downstream direction toward said axis, said sleeve terminating in an axial plane no further upstream than said liquid fuel tip, said axial flow passage decreasing in cross-sectional area in a downstream direction to accelerate air flow through said passage;

said gaseous/liquid fuel nozzle including a fuel gas nozzle comprised of a tubular member between said sleeve and said liquid fuel nozzle defining an annular passageway about said liquid fuel nozzle and a plurality of apertures in said tubular member spaced upstream from said liquid fuel tip and opening through said tubular member for flowing fuel gas into said converging flow passage when said gaseous/liquid fuel nozzle is operated in a fuel gas mode;

a first air swirler upstream of said fuel tip and said apertures for swirling air introduced into said air flow passage and delivering the swirling air about said liquid fuel spray pattern when in said liquid fuel mode and mixing with the fuel gas when in said fuel gas mode; and a second air swirler about said sleeve and disposed axially downstream of said first air swirler for swirling air received about said sleeve and flowing swirled air about said liquid fuel spray pattern;

whereby impingement of liquid fuel onto said gaseous/liquid fuel nozzle is substantially avoided.

2. A nozzle according to claim 1 wherein said sleeve terminates in an axial plane downstream of said liquid fuel tip.

3. A nozzle according to claim 1 wherein said first and second swirlers generate air flows swirling in the same direction.

4. A nozzle according to claim 1 wherein said first and second swirlers generate air flow swirling in opposite directions.

5. A nozzle according to claim 1 wherein the second swirler has a pressure drop thereacross to preclude liquid fuel contact with said second swirler.

6. A nozzle according to claim 1 wherein said sleeve terminates in an axial plane downstream of said liquid fuel tip, said first and second swirlers generating air flows swirling in the same direction.

7. A nozzle according to claim 1 wherein said sleeve terminates in an axial plane downstream of said liquid fuel tip, said first and second swirlers generating air flow swirling in opposite directions.

8. A dual-fuel nozzle for a gas turbine combustor, comprising:

a gaseous/liquid fuel nozzle defining an axis and including a liquid fuel nozzle terminating in a liquid fuel tip for injecting liquid fuel in a spray pattern toward a flame zone downstream of said nozzle when said gaseous/liquid fuel nozzle is operated in a liquid fuel mode;

a sleeve surrounding at least a portion of said gaseous/liquid fuel nozzle and in part defining a generally axially extending air flow passage convergent in a downstream direction toward said axis, said sleeve terminating in an axial plane no further upstream than said liquid fuel tip;

said liquid gaseous/fuel nozzle including a fuel gas nozzle comprised of a tubular member between said sleeve and said liquid fuel nozzle defining an annular passageway about said liquid fuel nozzle and a plurality of apertures in said tubular member spaced upstream from said liquid fuel tip and opening through said tubular member for flowing fuel gas into said converging flow passage when said gaseous/liquid fuel nozzle is operated in a fuel gas mode;

a first air swirler upstream of said fuel tip and said apertures for swirling air introduced into said air flow passage and delivering the swirling air about said liquid fuel spray pattern when in said liquid fuel mode and mixing with the fuel gas when in said fuel gas mode; and a second air swirler about said sleeve and disposed axially downstream of said first air swirler for swirling air received externally about said sleeve and flowing swirled air about said liquid fuel spray pattern;

whereby impingement of liquid fuel onto said gaseous/liquid fuel nozzle is substantially avoided.

9. A nozzle according to claim 8 wherein said flow passage defining means terminates in an axial plane downstream of said liquid fuel tip.

10. A nozzle according to claim 8 wherein said first and second swirlers generate air flows swirling in the same direction.

11. A nozzle according to claim 8 wherein said first and second swirlers generate air flow swirling in opposite directions.

* * * * *